US007439447B2

(12) United States Patent
Galey et al.

(10) Patent No.: US 7,439,447 B2
(45) Date of Patent: Oct. 21, 2008

(54) HYBRID VEHICLE RIGID ROUTING CABLE ASSEMBLY

(75) Inventors: David A. Galey, St. Croix, IN (US); Dennis L. Heinz, Floyds Knobs, IN (US); Michael J. Pruzin, Greenville, IN (US); Yoshiji Kinoshita, New Albany, IN (US); Mark A. Adams, Jeffersonville, IN (US); Troy J. Hickman, New Albany, IN (US); Patrick M. Houghlin, Floyds Knobs, IN (US); John R. Herron, Georgetown, IN (US)

(73) Assignee: Hitachi Cable Indiana, Inc., New Albany, IN (US)

( * ) Notice: Subject to any disclaimer, the term of this patent is extended or adjusted under 35 U.S.C. 154(b) by 250 days.

(21) Appl. No.: 11/144,907

(22) Filed: Jun. 3, 2005

(65) Prior Publication Data

US 2006/0272845 A1 Dec. 7, 2006

(51) Int. Cl.
*H01B 7/18* (2006.01)

(52) U.S. Cl. ..... 174/105 R; 174/120 R

(58) Field of Classification Search ..... 174/120 R, 174/105 R, 103

See application file for complete search history.

(56) References Cited

U.S. PATENT DOCUMENTS 3,509,266 A * 4/1970 Endacott ..... 174/15.6
3,784,730 A * 1/1974 Bannies ..... 174/75 C
3,833,755 A 9/1974 Soelberg
4,780,574 A * 10/1988 Neuroth ..... 174/102 D
5,120,905 A 6/1992 Cousin et al.
5,210,377 A 5/1993 Kennedy et al.
5,281,762 A * 1/1994 Long et al. ..... 174/78
5,414,217 A * 5/1995 Neuroth et al. ..... 174/120 R
5,477,011 A 12/1995 Singles et al.
5,493,070 A * 2/1996 Habu ..... 174/102 R
6,001,661 A 12/1999 McBean, Sr.
6,294,928 B1 9/2001 Lytle et al.
6,428,344 B1 * 8/2002 Reed ..... 439/455
6,583,360 B1 6/2003 Yudashkin
RE38,345 E * 12/2003 Falciglia et al. ..... 174/112
7,005,583 B2 * 2/2006 Varkey et al. ..... 174/120 R
2003/0029628 A1 2/2003 Uttinger et al.
2004/0099427 A1 5/2004 Kihira
2004/0164431 A1 8/2004 Seaman et al.
2004/0194996 A1 10/2004 Ysbrand
2005/0011687 A1 1/2005 Yamaguchi et al.
2006/0011376 A1 * 1/2006 Van Den Berg et al. .. 174/120 R

FOREIGN PATENT DOCUMENTS

DE 3110793 A1 10/1982
DE 4414052 A1 10/1995
FR 2762438 10/1998

* cited by examiner

*Primary Examiner*—Chau N Nguyen
(74) *Attorney, Agent, or Firm*—Alexander Brackett; Middleton Reutlinger

(57) ABSTRACT

The present invention is a routable rigid conductor assembly 10 having a core conductor 20 with a plurality of insulating dielectric layers and an armored exterior layer 70 that is capable of being routed to effect electrical transmission to, for example, a hybrid vehicle electric motor. The conductor assembly 10 of the present invention may be shaped to conform to specific routing configurations required for power transmission in a wide variety of industrial applications while providing impact protection to the conductor inside the assembly.

19 Claims, 5 Drawing Sheets

HYBRID VEHICLE RIGID ROUTING CABLE ASSEMBLY

BACKGROUND OF THE INVENTION

Field of the Invention

The present invention relates generally to a cable system for transmission of electrical power between two points and more specifically to a rigid conductor assembly having a core conductor with a plurality of insulating dielectric layers and an armored exterior layer that is capable of being routed to effect electrical transmission to, for example, a hybrid vehicle transmission. The conductor assembly of the present invention incorporates a transition from a flexible section to a rigid section that may be bent or shaped to conform to specific routing configurations required for power transmission in a wide variety of automotive and industrial applications while providing impact protection and electromagnetic interference protection to the conductor inside the assembly.

SUMMARY OF THE INVENTION

The present invention provides a rigid routable cable system for transmission of electrical power that is relatively simple in its construction and capable of automated assembly by modern manufacturing technique. The invention utilizes a core conductor element comprised of a either a solid or stranded electrically conductive material, for example copper or an alloy thereof, that permits the conductor assembly to be easily formed or bent and thereby easily routed and installed while minimizing the labor costs attendant thereto. Furthermore, a plurality of concentric dielectric layers surrounding the core conductor element are provided to enhance the structural integrity, safety and workability of the assembly.

A core element that may be comprised of solid copper is first provided with a first coating along its entire length that provides electrical insulation and further functions as a dielectric material. A second coating providing that also provides high voltage insulation and dielectric properties may then be disposed over the first coating. Next a tetrafluoroethylene insulation layer, hereinafter referred to as Teflon®, is provided over the second coating, which functions as a further dielectric for the underlying core conductor element and provides compressive strength to the entire assembly.

Alternatively, the core element may be comprised of a stranded copper alloy conductor having a fluoroelastomer or fluororubber coating disposed thereon to provide resistance to heat and chemical constituents. This embodiment of the present invention facilitates the transmission of electrical power without the attendant heat-related energy losses inherent with the use of solid conductors.

The conductor assembly further includes an armored, conductive tubing element disposed over the insulating layer along the length of the conductor to provide structural integrity to the assembly. Finally, the tubing element may be coated with an environmentally protective coating to inhibit corrosion and the effects of incidental contact from foreign objects.

The conductor assembly of the present invention may further include an integrally formed termination lug at either end of the core conductor element to facilitate the attachment of the conductor to a terminal. This feature of the invention permits quick terminations of power conductors while offering substantial cost savings over known in the art termination methods. Furthermore, the integrally formed termination lug provides a very secure and electrically efficient connection of the conductor to a terminal.

Accordingly, the conductor assembly of the present invention provides a routable conductor assembly that is extremely durable and resistant to mechanical stresses. Furthermore, the assembly provides electromagnetic interference (EMI) shielding along its entire length, thereby making it suitable for use in environments wherein electronic components that may be sensitive to electromagnetic radiation must be used, and also suitable for protecting the conductor within the assembly in environments containing high levels of electromagnetic radiation that would otherwise interfere with electrical transmission.

BRIEF DESCRIPTION OF THE DRAWING FIGURES

DETAILED DESCRIPTION OF THE PREFERRED EMBODIMENT(S)

Figure 1:
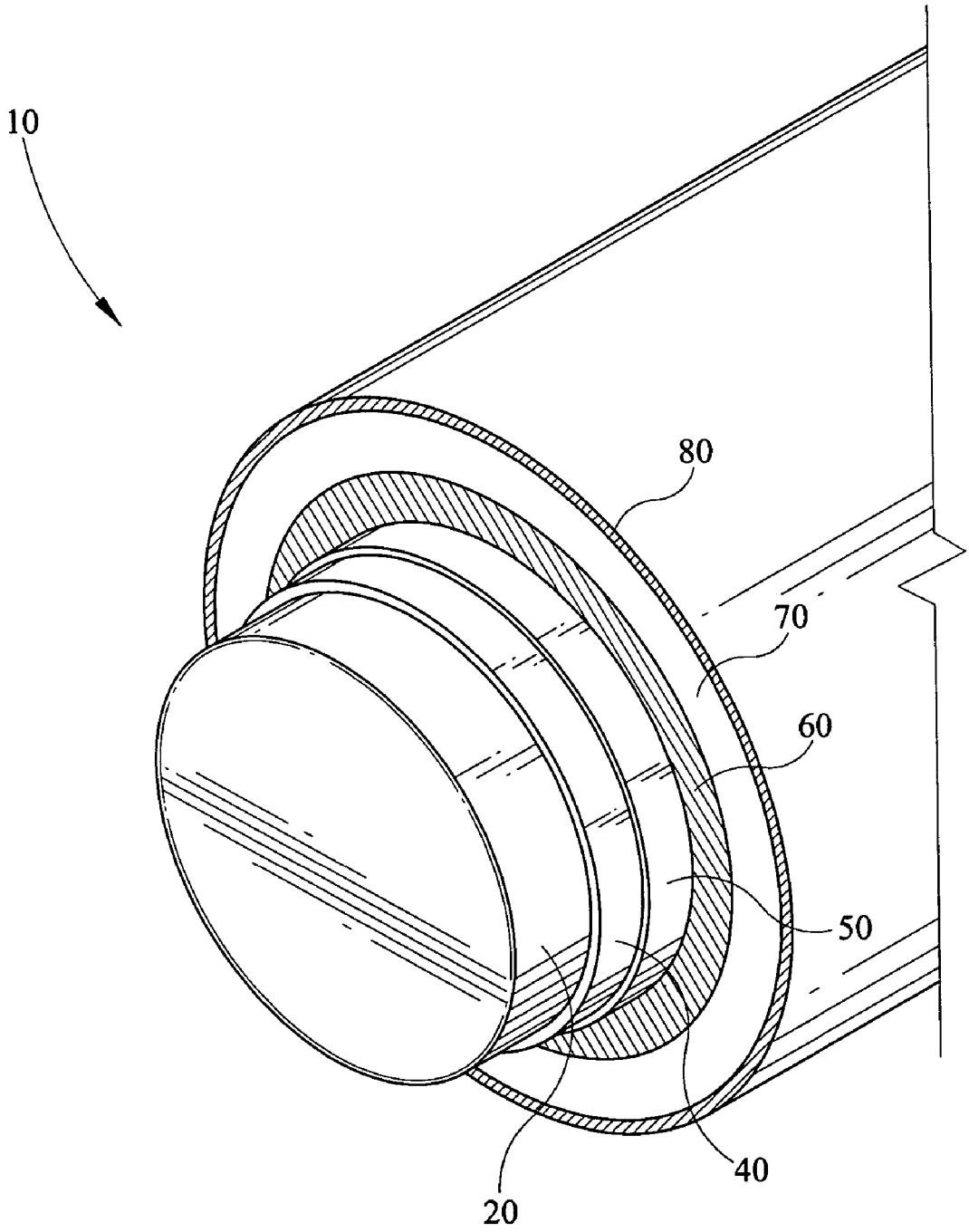
FIG. 1 is a cross-sectional view of a single conductor assembly in accordance with one embodiment of the present invention.

Referring now to FIG. 1, and in accordance with a preferred constructed embodiment of the present invention, a routable conductor assembly 10 for transmission of electrical power, including high voltage power transmission, includes a core conductor element 20 that may be comprised of a solid metal or metal alloy that is a good conductor of electrical power, for example copper and alloys thereof. Alternatively the core conductor element 20 may be comprised of a stranded metal or metal alloy that is a good electrical conductor. Furthermore, the core conductor element 20 is sufficiently ductile and malleable to permit it to be bent or shaped as required for the conductor 10 to traverse a predetermined route. The core element 20 may be cut to a predetermined length, as will be discussed in greater detail herein below.

Where a solid conductor core element 20 is used, a first coating 40 is concentric with and covers the core element 20 along substantially its entire length. The first coating 40 may be any polymer film coating or enamel coating suitable for use as an insulator and dielectric material that is cable of withstanding temperatures of at least 200 degrees Celsius. In one embodiment of the invention the first coating 40 provides an insulator for voltages at least as high as 2500 volts. In another embodiment of the invention, an inverter grade enamel may be employed as a first coating 40 to provide insulation protection up to 4000 volts at 200 degrees Celsius. This embodiment of the invention provides a first coating 40 that adheres readily to the core element 20 and is a good insulator. Additionally, a THEIC (tri-hydroxyethyl isocyanurate) modified polyfilm coating may be employed as a first coating 40 to provide greater resistance to moisture and high temperatures which may damage the core element 20. A THEIC modified coating marketed under the name Armored Poly-Thermaleze® may be obtained from the Phelps Dodge Company.

In an alternative embodiment of the present invention, wherein a stranded conductor core element 20 is employed, the first coating 40 is a fluoroelastomer coating disposed over the core element 20. As one example of a suitable fluoroelastomer coating, Flounlex® insulation may be employed as a first coating 40 over a core element 20 comprised of tinned annealed stranded copper wire. Alternatively, the first coating 40 may comprise a Teflon® coating or tube, or an electrically insulating tape or wrap. In this embodiment of the invention, a separator may be disposed between the core element 20 and the first coating 40, to add an additional dielectric layer to the assembly 10. The separator (not shown) facilitates stripping the insulating layer from the core element 20 when required. As is well known to one of ordinary skill in the art, the separator may comprise a paper tape or the like, and is used to facilitate the stripping of the insulating layer from the core element 20.

In one embodiment of the present invention, a second coating 50 is disposed over the first coating 40 along substantially the entire length of the conductor assembly 10 to provide an additional dielectric and protective layer thereto. The second coating 50 may be comprised either of polyester or of a polyester fiber/glass fiber coating such as Daglas® which is produced by the Phelps Dodge Company. This embodiment of the present invention provides a further dielectric layer over the core element 20 that is resistant to abrasion and fraying, thereby providing additional protection the core element 20 and is capable of withstanding temperatures in excess of 200 degrees Celsius.

Over the second coating 50 is a third coating 60 comprised of a fluoropolymer is disposed to provide an additional layer of insulation and add compressive strength to the conductor 10 while simultaneously offering an additional moisture barrier. In one embodiment of the present invention, the third coating 60 is a flouropolymer tubing, for example tetrafluoroethylene (Teflon®) tubing that is sized to be slip-fitted over the preceding layers of the conductor assembly 10. Teflon® may be advantageously employed because it is an excellent dielectric material, is resistant to chemicals and solvents and provides great compressive strength since it does not thin (or thicken a great deal) when subjected to mechanical operation such as bending or flexing. Additionally, the resistance to high temperatures offered by Teflon® permits the use of the present invention in extreme temperature applications. Furthermore, this feature of the present invention inhibits the core element 20 from compressing when bent, thereby permitting the conductor assembly 10 to be safely and readily configured to a desired routing pattern. Slip-fitting the Teflon® tubing over the preceding layers of the conductor assembly 10 permits the Teflon® coating to expand and contract at a rate different than that of the other layers of the assembly 10 without affecting its integrity.

In an alternative embodiment of the present invention, tubing comprising a combination of Teflon® and fiberglass, for example a braided fiberglass tube having a Teflon® coating, may be employed as a third coating 60. Where the combination fiberglass/Teflon coating is employed, the fiberglass must not contain conductive impurities so as to degrade the insulating and dielectric properties of the third coating 60.

Next an armored tube layer 70 is disposed over the third coating 60 to provide armoring, electromagnetic shielding, rigidity, and corrosion resistance for all the interior layers of the conductor 10 assembly. The armored tube layer 70 may be an aluminum or aluminum alloy tube sized to be slip-fit over the preceding layers of the assembly discussed herein above. Although various materials such as silver, copper, titanium or steel may be utilized as an armored tube layer 70, in one embodiment of the present invention an aluminum tubing having an anodized coating layer 80 is fitted over the preceding layers of the conductor assembly 10. This embodiment of the invention provides an armored tubing layer 70 that may be utilized in, for example, automotive applications since it is capable of meeting or exceeding requirements for automotive use. Furthermore, the aluminum tube functions to suppress EMI interference generated by electrical power transmitted through the core element 20, making the present invention suitable for use in applications such as automotive and aircraft construction, where sensitive electronic equipment must be located proximate an assembly 10 that potentially carries high-voltage power.

In a further embodiment of the present invention, a coating layer 80 may comprise a nylon coating disposed over the metallic tube layer 70 along the length of the conductor assembly 10 to provide additional resistance to corrosion and damage from foreign objects. The nylon coating layer 80 may be supplied in conjunction with the armored tube layer 70 as a finished product. Nylon coated aluminum tube is commercially available from a plurality of manufacturers and suppliers.

In a further embodiment of the present invention, when a solid conductor core element 20 is employed, an integral terminal lug 22 may be formed at an end of the conductor assembly 10. In this embodiment of the invention, the exterior layers of the conductor assembly 10 are removed from a portion thereof proximate an end, leaving an end portion of the core element 20 exposed. This end portion may be stamped or pressed to form an integral terminal lug 22 that facilitates quick and inexpensive termination of the conductor assembly 10, as well as providing a high-strength, electrically efficient termination system.

In a yet further embodiment of the present invention a tubular braided shield may be disposed between the first coating 40 and the third coating 60 to effect additional EMI shielding of the core element 20. In one embodiment of the invention, the braided shield may be comprised of a tinned copper.

Figure 4:
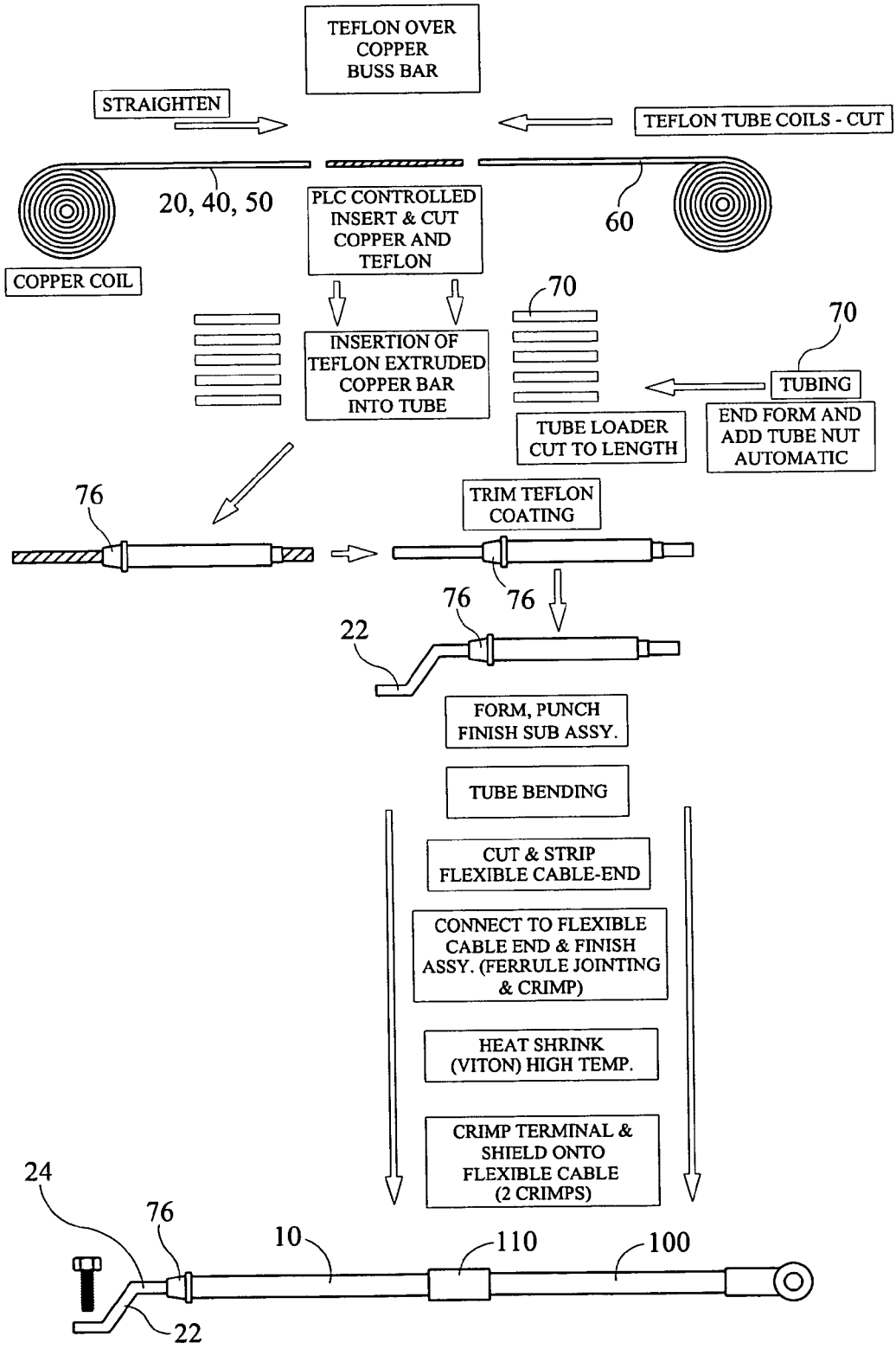
FIG. 4 is a block diagram of a system for constructing the conductor assembly in accordance with one embodiment of the present invention.
Figure 5:
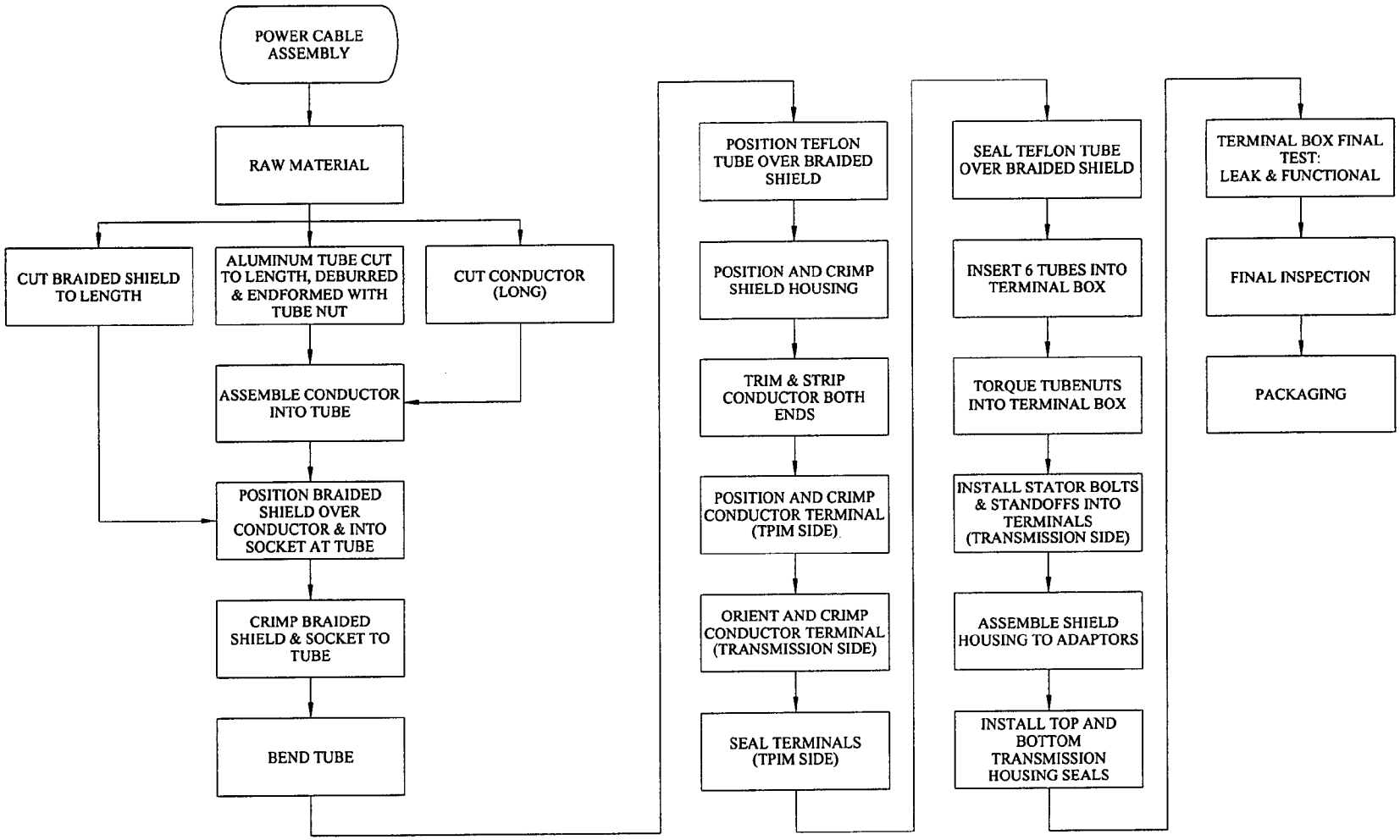
FIG. 5 is a block diagram of a system and method for constructing the conductor assembly in accordance with one embodiment of the present invention.

Referring now to FIGS. 4 and 5, a method for production of the conductor 10 described herein above, is initiated by unspooling and straightening a spool of solid copper or copper alloy wire that functions as a core element 20. The straightened core element 20 is then coated with the first and second coatings 40 and 50 respectively as discussed herein above. In an alternative embodiment of the invention, the core element 20 may be purchased from a supplier with the first and second coatings already applied thereto. Furthermore, where the second coating 50 is comprised of a polyester fiber/glass fiber coating such as Daglas®, the core element 20 may be machine wound with the Daglas® coating.

Where it is desirable to utilize a stranded conductor core element 20, for example in AC power transmission applications, a fluoroelastomer coated stranded conductor may be employed, for example a Flounlex® coated stranded copper cable available from Hitachi Cable Indiana, Inc. This feature of the present invention provides a core element 20 that is resistant to high temperatures and many corrosive chemicals, thereby making it suitable for use in hostile environment applications such as automotive, aircraft and naval applications. In this embodiment of the present invention, it is not necessary to employ the second coating 50 as detailed herein above. In a yet further alternative embodiment of the present invention, wherein a stranded conductor core element 20 in conjunction with a fluoroelastomer coating such as that discussed herein above, the assembly 10 of the present invention may be produced without the use of the third coating 60.

A coil of flouropolymer tubing serving as a third coating 60 is also un-spooled, straightened, and then cut to the desired length of the assembly 10. For purposes of the present description of the invention, Teflon® tubing will be used, although one of ordinary skill in the art will realize that a wide variety of flouropolymer coatings may be employed. A length of coated core element 20 is next inserted into the length of flouropolymer tubing 60 in a slip-fit construction, thence cut to a predetermined length. The process of un-spooling and straightening of both the core element 20 and fluoropolymer tubing 60 may be automated by a programmable logic controller or similar process automation controller, thereby minimizing labor costs and enhancing the speed of production of the conductor assembly 10.

Next, the metallic tube 70 is cut to a predetermined length sufficient to cover a portion of the core element 20 assembly to be protected by the tube 70. In other words, the length of metallic tube layer 70 is not necessarily required to be as long as the length of the core element 20, since a portion of the core element 20 at either end thereof may be exposed and thence terminated at a terminal or other termination point. In one embodiment of the present invention the metallic tube 70 may be purchased from a suitable supplier with the nylon coating layer 80 already in place.

Figure 3:
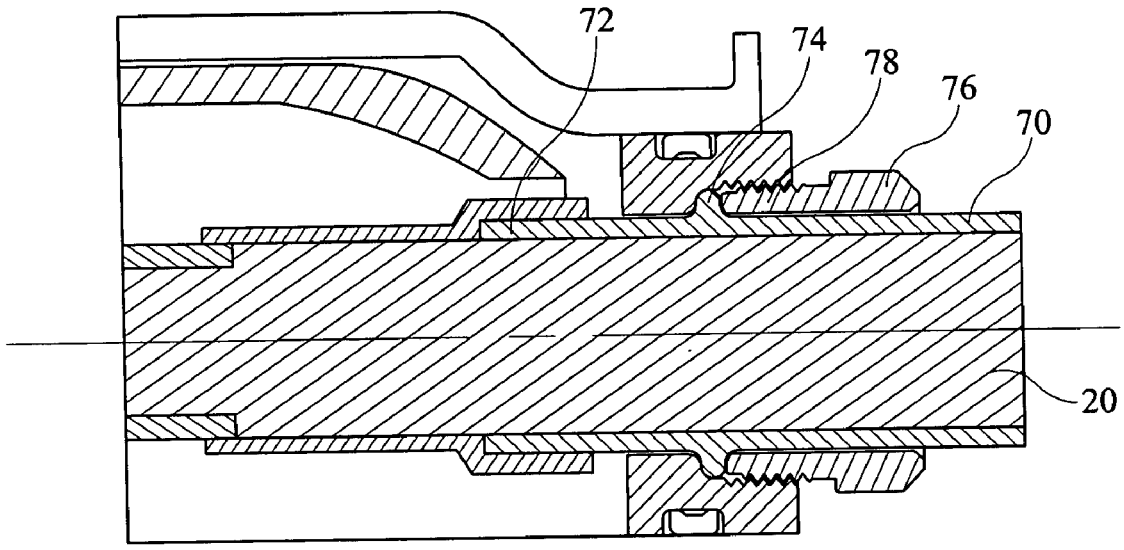
FIG. 3 is a partial cross-sectional view of an end of a single conductor assembly in accordance with one embodiment of the present invention.

As best seen in FIG. 3, and in accordance with an alternative embodiment of the present invention, a stop bead 74 is formed at an end 72 of the metallic tube 70 by subjecting the tube end 72 to an impact, thereby causing a bulge or bead to form proximate the impacted end. Additionally, a tube nut 76 having a plurality of conventional screw threads disposed circumferentially around a portion thereof may be placed over the tube 70, either before the step of forming the stop bead 74, or thereafter by sliding the nut 76 over the end 72 of the tube 70 that does not have the stop bead 74.

The tube nut 76 is positioned such that an interior portion 78 of the nut 76 contacts the stop bead 72 at one end of the tube 70 while the threads extend over the bead 74 towards the tube end 72, and may thusly be used to secure the tube end 72 (and therefore the conductor 10) to a connector or the like having corresponding mating threads. This feature of the present invention permits for quick and positive coupling and decoupling of the conductor 10 assembly to a housing or the like, at a point where the core element 20 may be required to extend further into the housing to a termination point, for example at the entrance to a transmission housing of a hybrid or electric vehicle.

In one embodiment of the present invention, the portion of tube between the tube end 72 and the stop bead 74 is left uncoated such that the shield of a mating conductor may be crimped to make positive electrical contact with the tube 70. This feature of the invention provides for continuity of EMI shielding from the assembly 10 to a mating cable or conductor.

Once the metallic tube 70 is cut to length, the Teflon® tube 60 and core element 20 assembly are inserted therein. This insertion process, as well as the end forming process described herein above may also be accomplished utilizing conventional process automation controls. Next, any excess Teflon® tube 60 and/or Daglas® insulation may be stripped back from either end of the core element 20 in order to provide access to the core element 20 for any necessary termination hardware. In one embodiment of the instant invention, wherein the core element 20 is a solid conductor, an integral terminal lug 22 that facilitates quick and inexpensive termination of the conductor 10 is formed and punched in one end 22 of the core element 20. The terminal lug 22 may include an angled portion or portions 24 to provide accurate conductor positioning at a termination point. Alternatively, where a stranded conductor core element 20 is used, a conventional terminal lug may be crimped onto one or both ends thereof to facilitate termination of the assembly 10.

Figure 2:
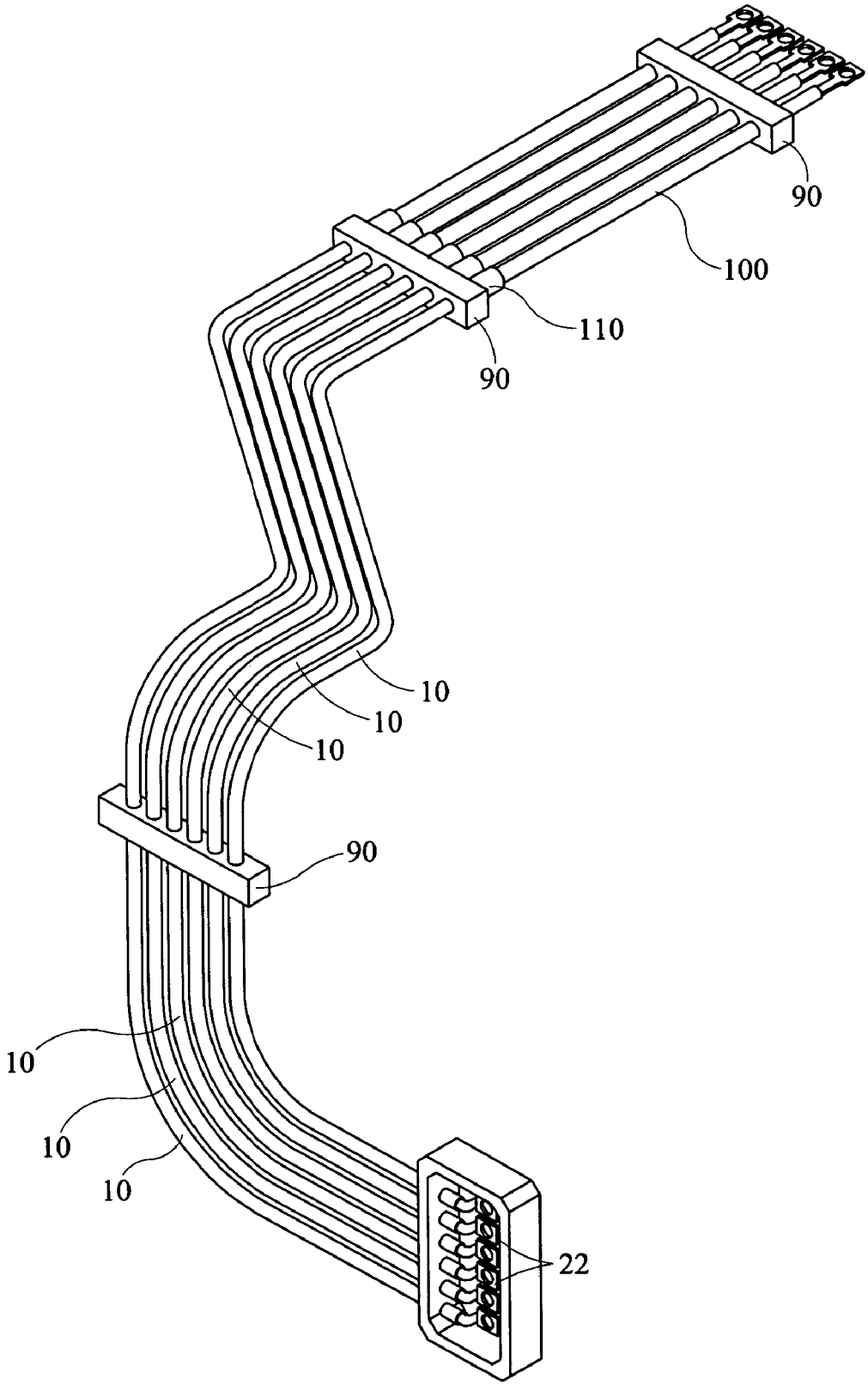
FIG. 2 is an isometric view of a plurality of conductor assemblies employed in concert in accordance with one embodiment of the present invention.

If necessary, the conductor assembly 10 may be bent to conform to a particular route through an assembly or structure, for example a power wiring route between a motor and transmission in an electric or hybrid vehicle, or between a generator and power substation or the like. Where multiple conductor assemblies 10 are used, for example in multi-phase power applications, each assembly 10 can be both sized (lengthwise) and bent to conform to the necessary route. This feature of the present invention is useful for routing and installing a plurality of conductor assemblies 10, since the assemblies can easily be held in spaced relation and affixed to a stationary structure by simple mounting brackets 90, as seen in FIG. 2.

In one embodiment of the present invention, individual conductor assemblies 10 are shaped using a suitably programmed computerized numerically controlled (CNC) robotic bender, wherein a straight conductor assembly 10 is held horizontally then sequentially bent around a plurality of dies until the desired route shape is achieved. Furthermore, this feature of the present invention permits the mass production of a multi-phase rigid routable conductor assembly since a plurality of individual bent conductor assemblies 10 may be shaped to conform to one another, thence secured together using brackets prior to packaging and shipping (if desired) to an end user.

In a yet further embodiment of the present invention, one end 24 of the core element 20 may be terminated to a flexible stranded conductor 100, for example a Fluonlex® cable or an equivalent thereof, using a ferrule termination 110 wherein both the core element 20 and the stranded conductor 100 are inserted into the ferrule thence crimped together. This feature of the present invention permits great flexibility in terminating one end 24 of the core element 20, since the flexible stranded conductor 100 may be more easily routed to any required termination point than the rigid routable conductor assembly 10, which must be bent or shaped. Furthermore, flexible stranded conductor 100 may include a conventional crimp-on lug terminal at one end thereof.

The foregoing detailed description of the embodiments of the invention is presented primarily for clearness of understanding and no unnecessary limitations are to be understood or implied therefrom. Modifications to the present invention in its various embodiments will become obvious to those skilled in the art upon reading this disclosure and may be made without departing from scope of the invention and the claims appended hereto.

We claim:

1. A rigid routable conductor assembly for transmission of electricity comprising:

a core element for conducting electricity;

a polymer film coating disposed coaxially with and around said core element for insulating said core element;

a polytetrafluoroethylene insulator disposed coaxially with and around said first coating for providing insulation and compressive strength to said core element;

a rigid armored tube element disposed coaxially with and around said polytetrafluoroethylene insulator shaped to provide a predetermined conductor route; and a coating disposed coaxially with and around said armored tube element.

2. A routable conductor assembly as claimed in claim 1 wherein said coating of said armored tube element is an anodized coating.

3. A routable conductor assembly as claimed in claim 1 wherein said coating of said armored tube element is a nylon coating.

4. A routable conductor assembly as claimed in claim 1 further comprising a polyester coating disposed coaxially with and around said polymer film coating.

5. A routable conductor assembly as claimed in claim 1 further comprising a bead disposed circumferentially around said armored tube element proximate an end thereof, said bead abutting a mating surface and providing electrical continuity therewith.

6. A routable conductor assembly as claimed in claim 5 further comprising a tube nut disposed over said armored tube element.

7. A routable conductor assembly as claimed in claim 5 wherein said armored tube element comprises anodized aluminum tube.

8. A routable conductor assembly as claimed in claim 7 wherein the portion of said armored tube between the bead and the end of said tube is not anodized.

9. A routable conductor assembly as claimed in claim 1 wherein said armored tube element comprises anodized aluminum tube.

10. A routable conductor assembly as claimed in claim 1 wherein said core element is a solid electrical conductor.

11. A routable conductor assembly as claimed in claim 1 wherein said core element is a solid copper alloy conductor.

12. A routable conductor assembly as claimed in claim 1 wherein said core element is a stranded electrical conductor.

13. A routable conductor assembly as claimed in claim 12 wherein said first coating is a fluoroelastomer coating.

14. A routable conductor assembly as claimed in claim 1 wherein said core element is a stranded copper alloy conductor.

15. A routable conductor assembly as claimed in claim 14 wherein said first coating is a fluoroelastomer coating.

16. A rigid routable conductor assembly for use in electric power transmission comprising:

a plurality of rigid routable conductors comprising;

a core element for conducting electricity;

a first coating disposed coaxially with and around said core element for insulating said core element;

a polytetrafluoroethylene insulator disposed coaxially with and around said first coating for providing insulation and compressive strength to said core element;

a rigid armored tube element disposed coaxially with and around said polytetrafluoroethylene insulator; and an anodized coating disposed coaxially with and around said armored tube element; and wherein each of said conductors are shaped to be routed between a first point and a second point; and at least one mounting bracket adapted to secure the plurality of routable conductors, one to another, in spaced relation.

17. A routable conductor assembly for use in electric power transmission as claimed in claim 16 further comprising:

a plurality of terminals secured to at least one end of each of said routable conductors for terminating said conductors at a terminal.

18. The routable conductor assembly for use in electric power transmission of claim 16 wherein said plurality of conductors are shaped to be routed between a power inverter and an electric motor of a hybrid vehicle.

19. The routable conductor assembly for use in electric power transmission of claim 16 wherein at least one of said plurality of conductors is shaped to be routed between a battery and an inverter of a hybrid vehicle.

* * * * *